US005101612A

United States Patent [19]

Yamamoto et al.

[11] Patent Number: 5,101,612

[45] Date of Patent: Apr. 7, 1992

[54] CAPSULE FILLING APPARATUS

[75] Inventors: Taizo Yamamoto, Osaka; Hirokazu Konishi, Sakurai, both of Japan

[73] Assignee: Nippon Elanco Kabushiki Kaisha, Osaka, Japan

[21] Appl. No.: 690,766

[22] Filed: Apr. 24, 1991

[30] Foreign Application Priority Data

Apr. 26, 1990 [JP] Japan ..... 2-112616

[51] Int. Cl.[5] ..... B65B 57/10; A61J 5/00

[52] U.S. Cl. ..... 53/499; 53/57; 53/900

[58] Field of Search ..... 53/499, 497, 498, 493, 53/494, 57, 56, 55, 52, 900, 284.5, 281, 282, 283; 493/9

[56] References Cited

U.S. PATENT DOCUMENTS

| | | | |
|---|---|---|---|
| 3,070,932 | 1/1963 | Höfliger | 53/900 X |
| 3,126,088 | 3/1964 | Dudas | 53/499 X |
| 4,680,464 | 7/1987 | Bross | 53/57 X |
| 4,962,629 | 10/1990 | Focke | 53/498 X |
| 4,964,262 | 10/1990 | Moser et al. | 53/900 X |
| 5,018,335 | 5/1991 | Yamamoto et al. | 53/900 X |

OTHER PUBLICATIONS

T. Mosa, Japanese Laid-Open Patent Publication No. 52-39494, Mar. 26, 1977.

*Primary Examiner*—James F. Coan

*Attorney, Agent, or Firm*—Morrison & Foerster

[57] ABSTRACT

A capsule filling apparatus which fills capsules with tablets having the same cylindrical shape as the capsules, wherein each tablet is fed from a hopper in an upright posture and wherein the filling of tablets into the capsules is secured by detecting a pressure varying depending on the presence of tablets in delivering holes.

6 Claims, 2 Drawing Sheets

CAPSULE FILLING APPARATUS

BACKGROUND OF THE INVENTION

1. Field of the Invention

The present invention relates generally to a capsule filling apparatus, and more particularly to an apparatus for filling rigid capsules made of gelatin with tablets of the same cylindroidal shape as the capsule, wherein the capsules were held in an upright posture with the openings upward.

2. Description of the Prior Art

It is common practice to fill a rigid capsule made of gelatin with a fluid substance such as granular, powder or liquid medicine. Sometimes, such capsules are also filled with solid tablets, and in recent years, with tablets having the same cylindroidal shape as the capsule itself. Being covered with the capsule in this way, the tablet can be protected from damage or deformation. This is also advantageous in eliminating the necessity of putting identification marks or coloring directly upon the tablets but only putting it on the capsules themselves.

Japanese Laid-Open Patent Publication No. 52-39494 discloses an apparatus for filling a capsule with a disk-shaped tablet. In this capsule filling apparatus, a disk-shaped tablet fed into a chute is passed into a hole extending through a slider. The slider is then moved in the horizontal direction so as to send the tablet held inside the hole through a hole in a shutter into a capsule. The filling of the capsule is detected by the displacement of a detecting rod to be inserted in the capsule.

When a capsule is filled with a tablet having the same shape as the capsule, the tablet must be inserted upright into the capsule which is also held upright. It is difficult, however, to form a sequence of upright cylindroidal tablets in a vertical line. Tablets may not be fed continuously into capsules through the hole in the slider, thereby resulting in the failure of filling the capsules with them. The problem of empty capsules sometimes occurs. To solve this problem, care must be taken to maintain the supply of tablets into capsules.

The above-mentioned capsule filling apparatus employs a detecting rod which is inserted into a capsule after the capsule is filled with a tablet. The filling of the tablet is detected by the displacement of the detecting rod. In this arrangement, however, the detecting rod touches the tablet and may damage it. Moreover, ingredients of the tablet may stick to the tip of the detecting rod, which must be cleaned before a different kind of tablet is charged in the capsule.

Furthermore, when the capsule is filled with a capsule-shaped tablet, the upright tablet may not completely fit into the hole of the slider, and is likely to be suspended between the chute and the slider. When the slider is moved under this condition, the tablet may be cut off by a shearing force applied between the hole of the slider and the chute.

SUMMARY OF THE INVENTION

The capsule filling apparatus of this invention, which overcomes the above-discussed and numerous other disadvantages and deficiencies of the prior art, comprises a first tablet feed part for feeding tablets into a hopper one by one in an upright posture, a slider disposed below the first tablet feed part, the slider having holes each extending therethrough so as to allow the tablets fed from the first tablet feed part to pass therethrough, and a shutter disposed below the slider, the shutter having guiding holes each extending therethrough and facing at the bottom end each opening of the capsule body so as to allow the tablets fed from the slider to pass therethrough, and means for detecting whether the tablets are properly placed in the holes of the slider, the slider horizontally moving to enable the bottom end of each hole thereof to be positioned one time to face each guiding hole of the shutter and the other to face each means for detecting the tablets in the holes.

In a preferred embodiment, the means for detecting the tablets of the shutter comprises air suction tubes each provided with an air suction opening at the top thereof, the air suction opening having a smaller diameter than that of the tablet, pressure sensors for detecting the internal pressure of the air suction tubes, and an air suction pump for reducing the internal pressure of the air suction tubes.

In a preferred embodiment, the shutter is made movable in the same direction as the slider.

In a preferred embodiment, the first tablet feed part is attached to an eccentric portion of a rotation axis.

In a preferred embodiment, the hopper disposed in the first tablet feed part is oscillated in the horizontal direction.

In a preferred embodiment, the first tablet feed part includes a feed block having holes shaped like a truncated cone whose top opening is larger than the bottom opening, the diameter of the top opening being smaller than the length of the tablet, whereas that of the bottom opening larger than the width thereof.

Thus, the capsule filling apparatus described herein makes possible the objectives of (1) filling the capsule with a tablet of the same shape as the capsule smoothly and continuously by oscillating the hopper so that the tablets can be fed from the hopper without being caught, and (2) ensuring to detect whether the capsule body is completely filled with the tablet without damaging the tablet.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

One embodiment according to the present invention is described as follows.

Figure 1:
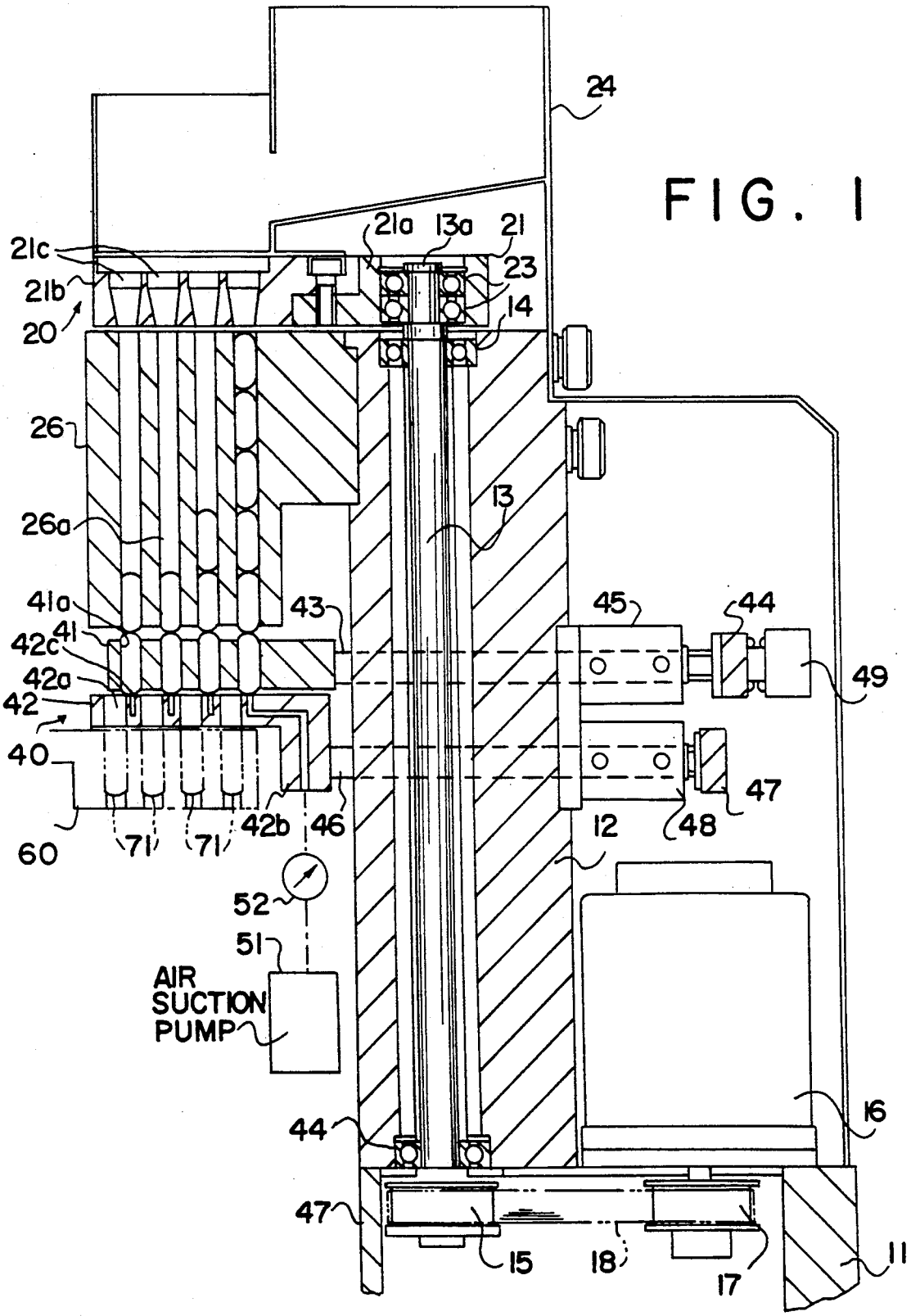
FIG. 1 is a sectional view of a main part of one embodiment of the capsule filling apparatus according to the present invention.

The capsule filling apparatus of this invention is used to fill a rigid capsule with a tablet of the same cylindroidal shape as the capsule. The capsule is formed of a cylindroidal capsule body and a capsule cap each with an opening at one end, and at the filling the capsule cap is separated from the capsule body. Before being filled with tablets by the capsule filling apparatus according to the present invention, a group of capsules are set in an array, by means of, for example, the capsule direction regulating mechanism disclosed in Japanese Laid-Open Patent Publication No. 61-211213, in such a manner that each capsule is placed upright with the capsule cap upward and the capsule body and capsule cap loosely connected so as to be easily separated from each other afterwards and still keeping the orderly array of the capsules. Then, the array of capsule bodies with a fixed space between them are conveyed in the horizontal direction to a fixed place by means of an annular capsule body conveying mechanism 60 disposed horizontally as shown in FIG. 1. The capsule bodies in the array are regularly arranged like a checkerboard.

The capsule filling apparatus according to the present invention is mounted on the side of the fixed place of the capsule body conveying mechanism 60 as shown in FIG. 1.

The capsule filling apparatus comprises a cylindrical support 12 vertically held onto a hollow base 11. At the upper portion of the support 12 is located a first feed part 20 which is supported by the support 12 and includes a hopper 24 for receiving tablets and a guide block 26 for guiding the tablets so that they are fed in an upright posture from the hopper 24. The guide block 26 is disposed to correspond to the fixed place of the capsule body conveying mechanism 60. Between the guide block 26 and the capsule body conveying mechanism 60 is located a second tablet feed part 40.

Through the cylindrical support 12 extends a rotation axis 13, of which top and bottom portions are rotatably secured to the top and bottom portions of the support 12 through bearings 14 and 44, respectively. The bottom portion of the rotation axis 13 extends beyond the bottom end of the support 12 to reach the inside of the base 11. A pulley 15 is connected around the extended bottom portion of the rotation axis 13. A motor 16 is mounted on the base 11 at the opposite side to the capsule body conveying mechanism 60 with respect to the support 12, so that its output axis is positioned in the vertical direction and extends downward into the base 11. A pulley 17 is connected around the extended bottom portion of the output axis. Between this pulley and the pulley 15 connected around the rotation axis 13 is wound a belt 18, so that the rotation generated by the motor 16 is transmitted to the rotation axis 13 through the belt 18.

The top portion of the rotation axis 13 extends beyond the top end of the support 12, and the extended portion of the rotation axis 13 forms an eccentric portion 13*a*. To the eccentric portion 13*a* is attached an oscillating portion 21 of the first tablet feed part 20.

The oscillating portion 21 includes a coupling block 21*a* disposed around the eccentric portion 13*a* and a feed block 21*b* horizontally supported by the coupling block 21*a*. The eccentric portion 13*a* is slightly made eccentric against the other portion of the rotation axis 13 secured within the support 12. The coupling block 21*a* is rotatably fitted around the eccentric portion 13*a* through a pair of bearings 23, causing the entire oscillating portion 21 to slightly oscillate in the horizontal direction when the rotation axis 13 rotates.

The hopper 24 is mounted on the feed block 21*b* supported by the coupling block 21*a*. Into the hopper 24 are supplied tablets 80 of the same cylindroidal shape as the capsule. The tablets 80 move within the hopper toward the area above the feed block 21*b*.

The feed block 21*b* is horizontally placed above the capsule body conveying mechanism 60. A plurality of holes 21*c* extend through the feed block 21*b* in the same arrangement as the array of capsule bodies 71 on the mechanism 60 so that each hole 21*c* corresponds to each capsule body 71. Each hole 21*c*, with the vertical axis, is shaped like a truncated cone with its top opening larger than its bottom opening. The top opening of the hole 21*c* has a diameter slightly smaller than the length of the capsule-shaped tablet 80, while the bottom opening thereof has a diameter slightly larger than the width of the tablet 80. When the oscillating portion 21 is oscillated through the rotation of the rotation axis 13, each tablet 80 in the hopper 24 starts to enter each hole 21*c* with a longitudinal end of the tablet ahead.

A number of chutes 26*a* extend through the guide block 26 attached to the upper portion of the support 12. The top end of each chute 26*a* roughly faces the bottom end of each hole 21*c* of the feed block 21*b*. The diameter of each chute 26*a* is slightly larger than the width of the tablet 80, so that the tablets 80 which have passed through the holes 21*c* are introduced one after another to the chutes 26*a* in a roughly upright posture. Each chute 26*a* is arranged to accommodate several upright tablets 80 (five in this embodiment) in a line.

The second tablet feed part 40 located below the guide block 26 includes a slider 41 horizontally disposed below the guide block 26 and a shutter 42 horizontally disposed below the slider 41. The slider 41 is supported by a pair of support axes 43 which horizontally extend through the support 12. The ends of the support axes 43 opposite the ones attached to the slider 41, which are located above the motor 16, are connected to each other by means of a coupling rod 44. Between the center portion of the coupling rod 44 and the support 12 is horizontally disposed an air cylinder 45, which operates to push the coupling rod 44 to move toward or away from the support 12, causing the synchronous parallel movement of the pair of support axes 43 in the horizontal direction.

To the air cylinder 45 is attached a load sensor 49 for detecting a high load applied to the air cylinder 45.

The slider 41 supported by the support axes 43 is provided with a number of holes 41*a* vertically extending therethrough. These holes 41*a* are formed in the same arrangement as the chutes 26*a* of the guide block 26 and accept the tablets 80. The length of each hole 41*a* is made slightly smaller than the length of the tablet 80. When the slider 41 moves toward the support 12 by the operation of the air cylinder 45, each hole 41*a* faces the bottom end of each chute 26*a* in an aligned condition. Meanwhile, when the slider 41 moves away from the support 12, the upper surface between the holes 41*a* of the slider 41 faces the bottom end of each chute 26*a*.

The shutter 42 disposed below the slider 41 is supported by a pair of support axes 46 horizontally extending through the support 12 in the same manner a the slider 41. The ends of the support axes 46 located above the motor 16 are connected to each other by means of a coupling rod 47. Between the center portion of the coupling rod 47 and the support 12 is horizontally disposed an air cylinder 48, which operates to push the coupling rod 47 to move toward or away from the support 12, causing the synchronous parallel movement of the pair of support axes 46 in the horizontal direction.

The shutter 42 is provided with a number of guide holes 42*a* vertically extending therethrough. These guide holes 42*a* are formed in the same arrangement as the holes 41*a* of the slider 41 and the chutes 26*a* of the guide block 26. Normally, each guide hole 42*a* is made to face each hole 41*a* of the slider 41 when the slider 41 above the shutter 42 moves away from the support 12.

The shutter 42 is also provided with air suction openings 42c for air suction tubes 42b, each facing the axis portion of each hole 41a of the slider 41 when the slider 41 is moved toward the support 12. Each air suction opening 42c is made sufficiently smaller than the chute 26a in diameter to prevent the capsule-shaped tablet from entering the air suction opening. The air suction tubes 42b extend through the shutter 42 so as not to communicate with any of the guide holes 42a, and are connected to an air suction pump 51 at the ends. At a point along each air suction tube 42b is disposed a pressure sensor 52 which detects air pressure inside the air suction tube 42b.

The operation of the thus arranged capsule filling apparatus is described as follows.

When the capsule-shaped tablet 80 has been put in the hopper 24 of the first tablet feed part 20, the array of capsule bodies on the capsule body conveying mechanism 60 is brought below the second tablet feed part 40. At this time, both the slider 41 and the shutter 42 of the second tablet feed part 40 have been moved away from the support 12. (Refer to FIG. 3.) Under the above conditions, each capsule body 71 held on the capsule body conveying mechanism 60 with its opening upward faces each guide hole 42a of the shutter 42. The top end of each hole 41a of the slider 41 does not face the bottom end of each chute 26a of the guide block 26, which is therefore closed by the upper surface of the slider 41, while the lower end of each hole 41a of the slider 41 faces each guide hole 42a of the shutter 42.

First, under the above described conditions, the motor 16 is driven to initiate the rotation of the rotation axis 13 which extends through the support 12. Then, the eccentric portion 13a formed on the top portion of the rotation axis 13 is eccentrically rotated, causing the oscillating portion 21 attached to the eccentric portion 13a to oscillate in the horizontal direction. This horizontal oscillation is transmitted to the hopper 24 mounted on the oscillating portion 21, giving vibration to the tablets 80 inside the hopper 24. The vibrated capsule-shaped tablets 80 in the hopper 24 then start to enter each hole 21c of the feed block 21b one by one with a longitudinal end of the tablet ahead. The tablets 80 thus made to stand in an upright posture through each hole 21c then fall one by one into each chute 26a of the guide block 26, forming a continuous line of upright tablets in each chute 26a as the bottom end thereof is closed by the upper surface of the slider 41 at this time.

Figure 2:
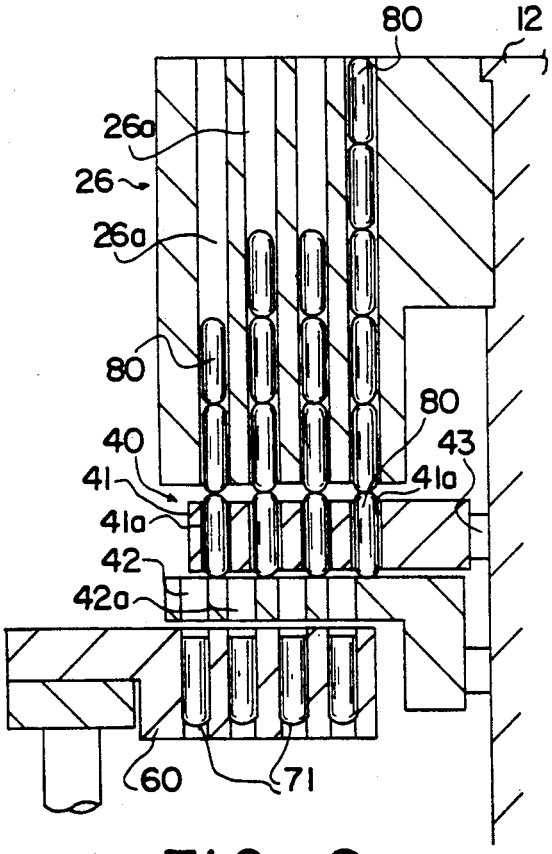
FIG. 2 and FIG. 3 are partial sectional views illustrating the operation of the embodiment of FIG. 1, respectively.

Second, the air cylinder 45 is driven so as to cause the slider 41 of the second tablet feed part 40 to horizontally move toward the support 12. Hence, as shown in FIG. 2, each hole 41a of the slider 41 faces each chute 26a of the guide block 26 at the top end and faces each air suction opening 42c of the shutter 42 at the bottom end. Under this positioning, the tablet 80 placed on the bottom of each chute 26a of the guide block 41 falls into the hole 41a of the slider 41 by its own weight. As the bottom end of each hole 41a of the slider 41 faces each air suction opening 42c of the shutter 42, the tablet 80 is not passed through but held within the hole 41a. At this time, the bottom end of the tablet 80 closes the air suction opening 42c.

Third, the air suction pump 51 connected to the air suction tubes 42b is used to reduce the pressure inside the air suction tubes 42b. When the air suction opening 42c is closed by the bottom end of the tablet 80, air will not enter from the air suction opening 42c and the internal pressure of the air suction tube 42b is reduced. Therefore, when all of the holes 41a of the slider 41 are filled with tablets 80 closing all of the air suction openings 42c, the internal pressure of the air suction tubes 42b decreases to a prescribed degree. On the other hand, when any of the holes 41a is not filled with the tablet 80, the air suction opening 42c facing the hole 41a is not closed by the tablet 80, allowing the air flow through the air suction tube 42b and thus failing to decrease the internal pressure thereof to the prescribed degree. The pressure sensors 52 disposed in the air suction tubes 42b detect the internal pressure of the air suction tubes 42b to determine whether all of the holes 41a of the slider 41 are filled with the tablets 80.

Incidentally, when any hole 41a of the slider 41 is not filled with the tablet 80, the tablet 80 placed in the chute 26a of the guide block 26 may be sucked into the hole 41a by the air suction at the air suction opening 42c.

Figure 3:
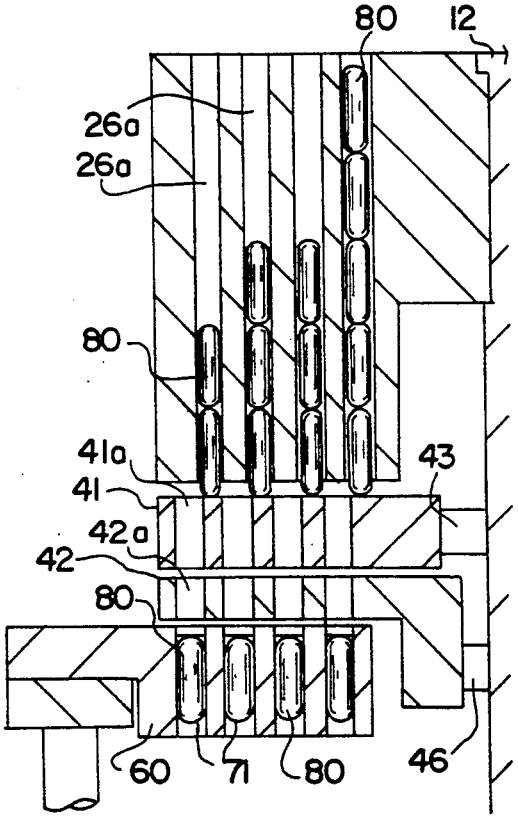

Fourth, the air cylinder 45 is used to allow the slider 41 to horizontally move away from the support 12. This causes the bottom end of each hole 41a of the slider 41 to face each guide hole 42a of the shutter 42. As shown in FIG. 3, the capsule-shaped tablet 80 held in each hole 41a of the slider 41 then falls through each guide hole 42a of the shutter 42 into each capsule body 71 held on the capsule body conveying mechanism 60. At this moment, the upper surface of the slider 41 closes the bottom end of each chute 26a of the guide block 26, not allowing the bottom tablet 80 in each chute 26a to fall into each hole 41a.

In the case where the tablet 80 held in the hole 41a of the slider 41 has not completely fallen into the guide hole 42a of the shutter 42 but is suspended between the two holes, the air cylinder 45 is heavily loaded when the slider 41 starts again to move toward the support 12. The load sensor 49 detects this loading and operates to initiate the air cylinder 48, which moves the shutter 42 toward the support 12, thus allowing the tablet 80 suspended between the two holes to fall into the guide hole 42a so as to be discharged. At this time, the capsule body conveying mechanism 60 has been moved away from the fixed place below the shutter 42.

Thus, when each capsule body 71 in the array on the fixed place of the capsule body conveying mechanism 60 completes the filling, the capsule body conveying mechanism 60 is driven to set a new array of empty capsule bodies on the fixed position below the second tablet feed part 40, and the same steps as described above are repeated.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A capsule filling apparatus for filling a capsule body held in an upright posture with the opening upward with a tablet of the same cylindroidal shape as the capsule comprising:

a first tablet feed part for feeding tablets into a hopper one by one in an upright posture;

a slider disposed below the first tablet feed part, the slider having holes each extending therethrough so as to allow the tablets fed from the first tablet feed part to pass therethrough; and a shutter disposed below the slider, the shutter having guiding holes each extending therethrough and facing at the bottom end each opening of the capsule body so as to allow the tablets fed from the slider to pass therethrough, and means for detecting whether the tablets are properly placed in the holes of the slider, the slider horizontally moving to enable the bottom end of each hole thereof to be positioned one time to face each guiding hole of the shutter and the other to face each means for detecting the tablets in the holes.

2. A capsule filling apparatus according to claim 1, wherein the means for detecting the tablets of the shutter comprises air suction tubes each provided with an air suction opening at the top thereof, the air suction opening having a smaller diameter than that of the tablet, pressure sensors for detecting the internal pressure of the air suction tubes, and an air suction pump for reducing the internal pressure of the air suction tubes.

3. A capsule filling apparatus according to claim 1, wherein the shutter is made movable in the same direction as the slider.

4. A capsule filling apparatus according to claim 1, wherein the first tablet feed part is attached to an eccentric portion of a rotation axis.

5. A capsule filling apparatus according to claim 1, wherein the hopper disposed in the first tablet feed part is oscillated in the horizontal direction.

6. A capsule filling apparatus according to claim 1, wherein the first tablet feed part includes a feed block having holes shaped like a truncated cone whose top opening is larger than the bottom opening, the diameter of the top opening being smaller than the length of the tablet, whereas that of the bottom opening larger than the width thereof.

* * * * *